United States Patent [19]

Swartwout

[11] 4,213,369

[45] Jul. 22, 1980

[54] APPALACHIAN DULCIMER LAPBOARD

[76] Inventor: Robert L. Swartwout, 7409 Baltimore Ave., Takoma Park, Md. 20012

[21] Appl. No.: 919,669

[22] Filed: Jun. 27, 1978

[51] Int. Cl.[3] ..... G10G 5/00

[52] U.S. Cl. ..... 84/284; 84/327

[58] Field of Search ..... 84/280, 284, 290, 327

[56] References Cited

U.S. PATENT DOCUMENTS

| | | | |
|---|---|---|---|
| 751,880 | 2/1904 | Stevenson | 84/327 |
| 1,261,841 | 4/1918 | Mortensen | 84/327 |
| 1,272,582 | 7/1918 | Vrubel | 84/327 |
| 1,285,802 | 11/1918 | Russell | 84/327 |
| 1,296,414 | 3/1919 | McLay | 84/280 |
| 1,708,285 | 4/1929 | Truett et al. | 84/327 |
| 1,772,308 | 8/1930 | Ezzelle | 84/280 |
| 1,945,162 | 1/1934 | Rasmussen | 84/327 |
| 2,039,985 | 5/1936 | Smullin | 84/327 |
| 2,069,436 | 2/1937 | Feldman | 84/327 |
| 2,575,569 | 11/1951 | Ungh | 84/280 |
| 2,664,777 | 1/1954 | Kopa | 84/327 |
| 2,814,229 | 11/1957 | Vaccaro et al. | 84/327 |
| 3,631,754 | 1/1972 | Kun | 84/280 |
| 4,099,441 | 7/1978 | Landon | 84/327 |

FOREIGN PATENT DOCUMENTS

| | | | |
|---|---|---|---|
| 357992 | 7/1940 | Fed. Rep. of Germany | 84/327 |

*Primary Examiner*—L. T. Hix
*Assistant Examiner*—Alan Mathews
*Attorney, Agent, or Firm*—Donald A. Kettlestrings

[57] ABSTRACT

A lapboard for an Appalachian dulcimer or like instrument holds the instrument in position on a person's lap and out of contact with the lap to enhance the tone level and quality of the instrument. Spring-loaded flap members of the lapboard contact the person's legs to prevent movement of the lapboard and of the instrument while the instrument is being played.

13 Claims, 15 Drawing Figures

Fig. 9.
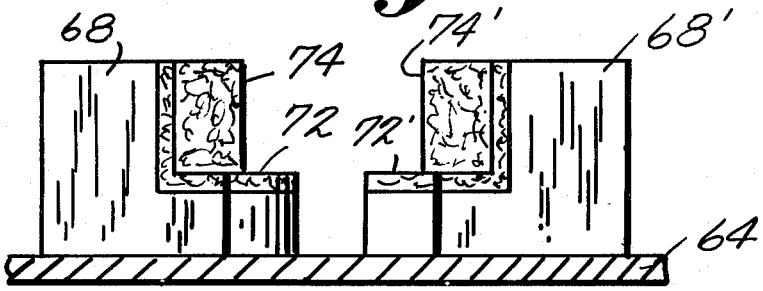
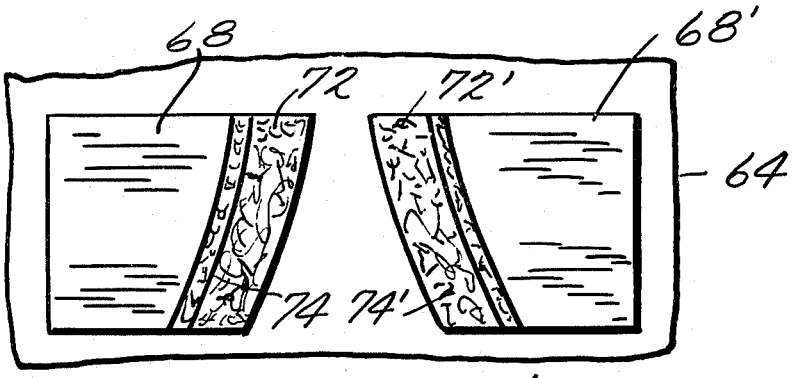
Fig. 10.
Fig. 11.
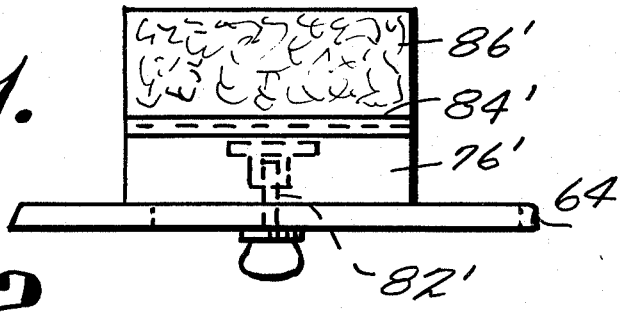
Fig. 12.
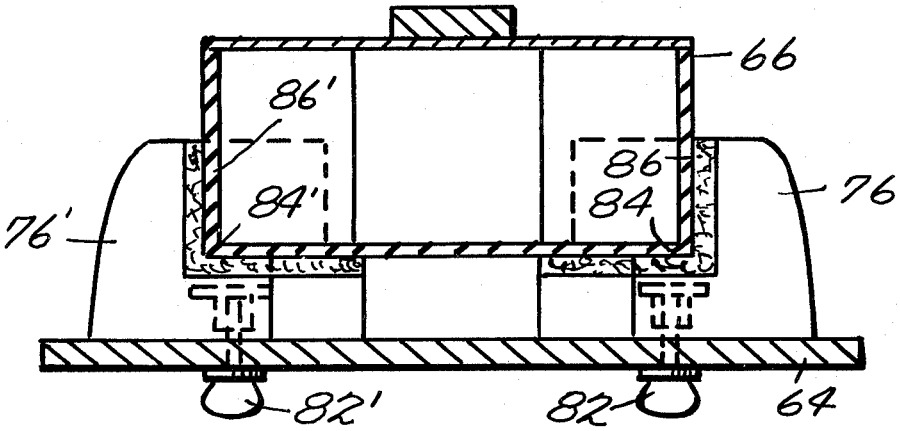

APPALACHIAN DULCIMER LAPBOARD

This invention relates to stringed musical instruments which are normally positioned on a person's lap while being played, and more particularly to a lapboard for supporting an Appalachian dulcimer or like instrument.

The normal playing position of an Appalachian dulcimer is across the lap with the scroll piece or peg block positioned to the performer's left. Played with a plectrum and noter or with the fingers of both hands, the instrument has a tendency to slide around on the lap, and the performer must also use his hands and fingers to stabilize the instrument, detracting from the playing of the instrument. Also, the bottom plate of the instrument heretofore has rested directly on the performer's lap, and this has dampened out and reduced the vibrations of the bottom plate so as to reduce the tone level and quality of the instrument.

It is, therefore, an object of the present invention to provide an Appalachian dulcimer lapboard for holding the dulcimer in place on the performer's lap while the instrument is being played.

Another object is to provide a lapboard for an Appalachian dulcimer or like instrument whereby the instrument is maintained out of contact with the performer's lap so as to enhance the tone level and quality of the instrument.

A further object of the invention is the provision of an Appalachian dulcimer or like instrument having a lapboard permanently built in to the instrument.

Still another object is to provide a lapboard for an Appalachian dulcimer or like instrument wherein spring-loaded flap members are provided for contacting the performer's legs and for holding the lapboard in position on the performer's lap.

Yet another object of the present invention is the provision of an adapter for use with the lapboard for accomodating a zither.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides apparatus for supporting the dulcimer or like instrument on a person's lap, the apparatus including first means for supporting and gripping the instrument, and means attached to the first means for grasping the person's legs, whereby the apparatus and the instrument are held in substantially fixed position on the person's lap.

Preferably, the first means include a base member and support means in operative relationship with the base member for receiving the instrument and for positioning the instrument in spaced apart relationship with respect to the base member. The base member is preferably substantially planar and the support means include first support members fixedly attached to and adjacent a first end of the base member and extending above the substantially planar surface of the base member, and second support members movably attached to and adjacent a second end of the base member and extending above the substantially planar surface of the base member.

Preferably, the means for grasping the person's legs include a first flap member hingedly attached to the base member at a predetermined, fixed location on the base member, a slide member movably attached to the base member, and a second flap member hingedly attached to the slide member whereby the distance between the flap members can be adjusted by movement of the slide member to accommodate different lap sizes.

The base member preferably defines a first pair of elongated openings extending in substantially parallel relationship to one another and located between the first and second support members, and the lapboard further preferably includes first fastening means extending through the openings and attached in adjustable relationship to the slide member for enabling the second flap member and the slide member to be moved relative to the first flap member.

In accordance with the invention, the base member also preferably defines a second pair of elongated openings located adjacent to the second end of the base member, and the lapboard also preferably includes second fastening means extending through the second pair of openings and attached in adjustable ralationship to the second support members for enabling the second support members to be moved to accommodate instruments of various sizes and shapes.

It is to be understood that both the foregoing general description and the following detailed description are exemplary and explanatory, but are not restrictive of the invention.

The accompanying drawings, which are incorporated in and constitute a part of this specification, illustrate examples of preferred embodiments of the invention and, together with the description, serve to explain the principles of the invention.

FIG. 9 is a fragmentary elevation view taken along the line 9—9 in FIG. 7 looking in the direction of the arrows;

FIG. 10 is a fragmentary top elevation view of the supporting elements shown in FIG. 9;

FIG. 11 is a fragmentary elevation view taken along line 11—11 in FIG. 7 looking in the direction of the arrows;

FIG. 12 is a sectional view taken along the line 12—12 of FIG. 7 looking in the direction of the arrows;

Figure 1:
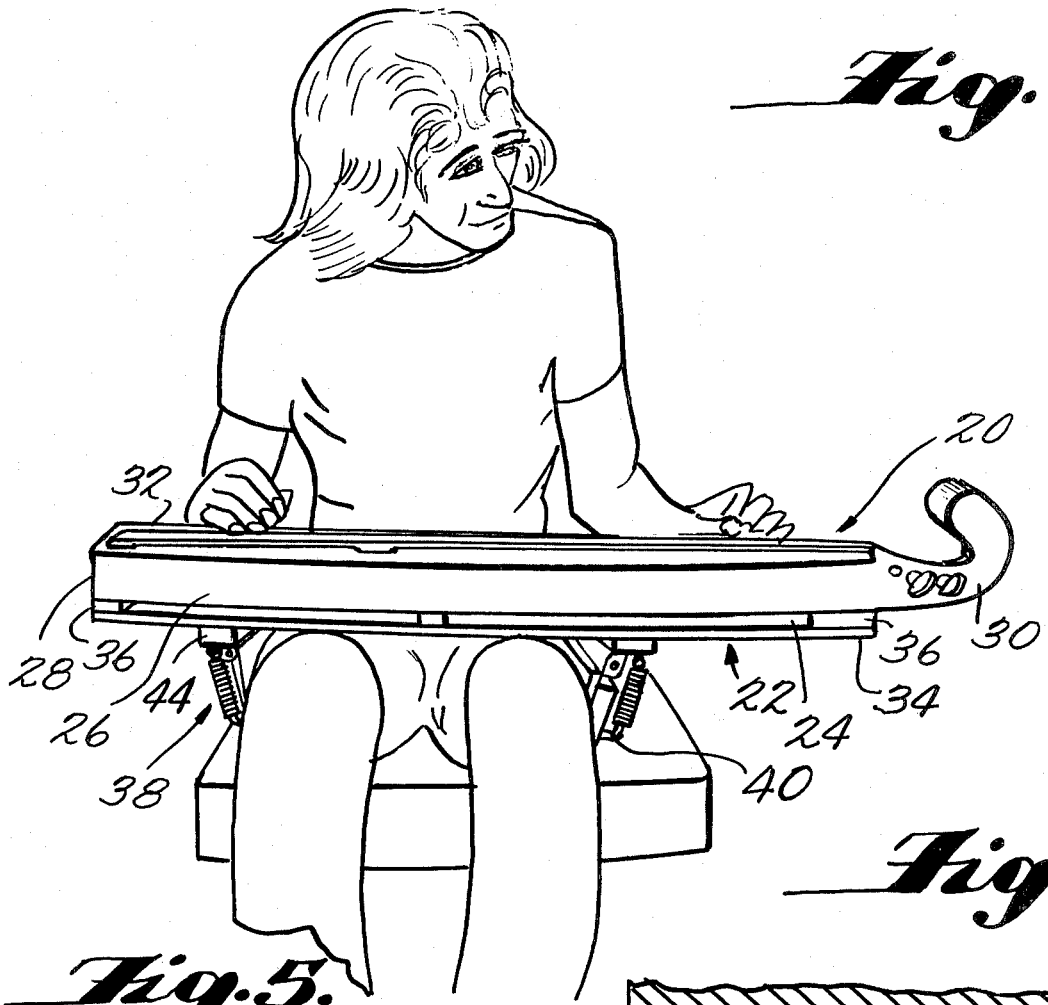
FIG. 1 is a perspective view of a dulcimer having a built-in lapboard in accordance with this invention.
Figure 6:
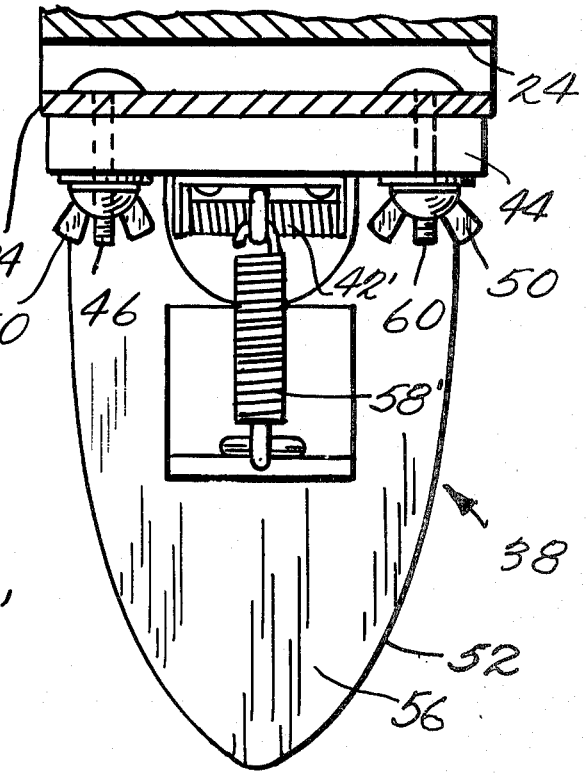
FIG. 6 is a fragmentary side elevation view of the lap gripping member and showing the spring mechanism for operating the gripping member.
Figure 5:
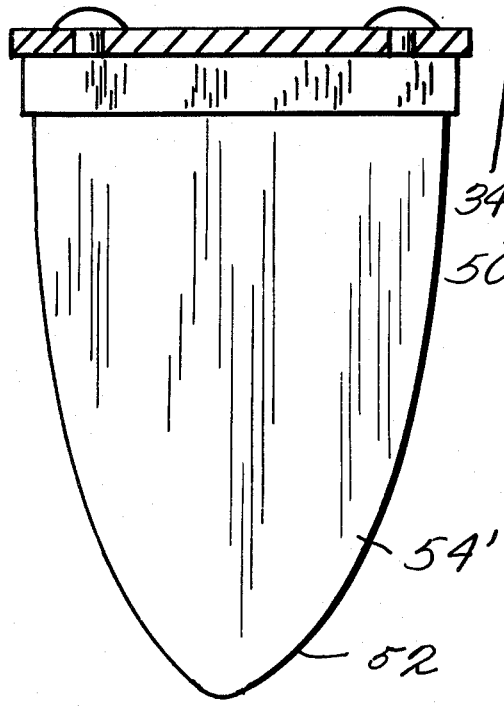
FIG. 5 is a fragmentary side elevation view of the gripping surface of a lap or leg gripping member of the instrument.
Figure 2:
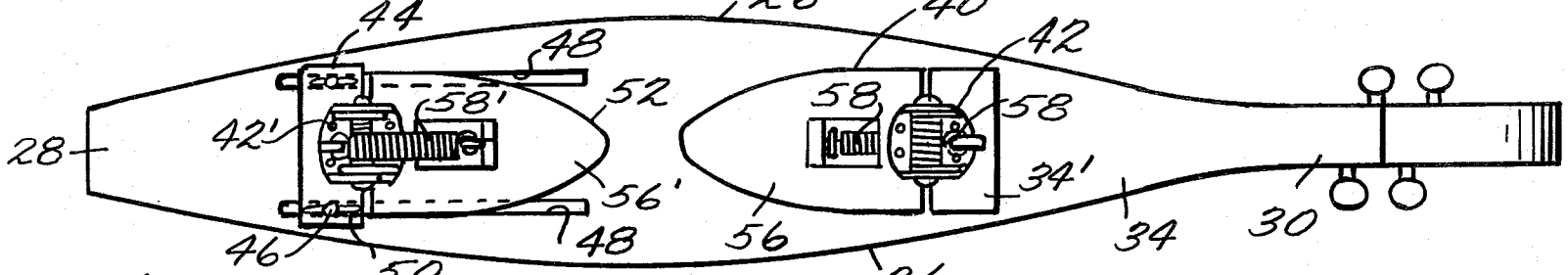
FIG. 2 is a bottom plan view of the instrument shown in FIG. 1.
Figure 3:
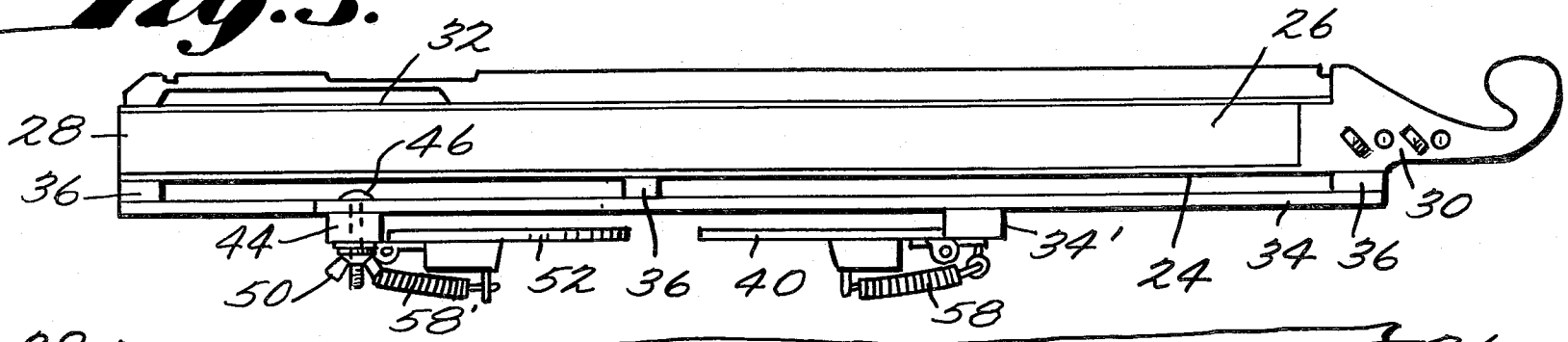
FIG. 3 is a side elevation view of the instrument.
Figure 4:
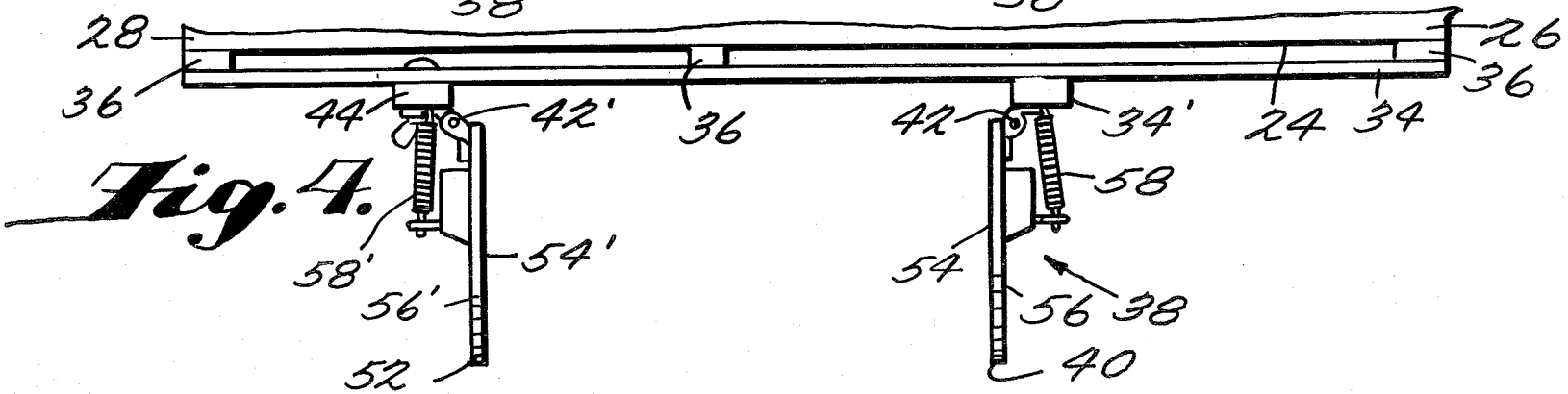
FIG. 4 is a fragmentary side elevation view of the instrument with the lap gripping members extended.
Figure 7:
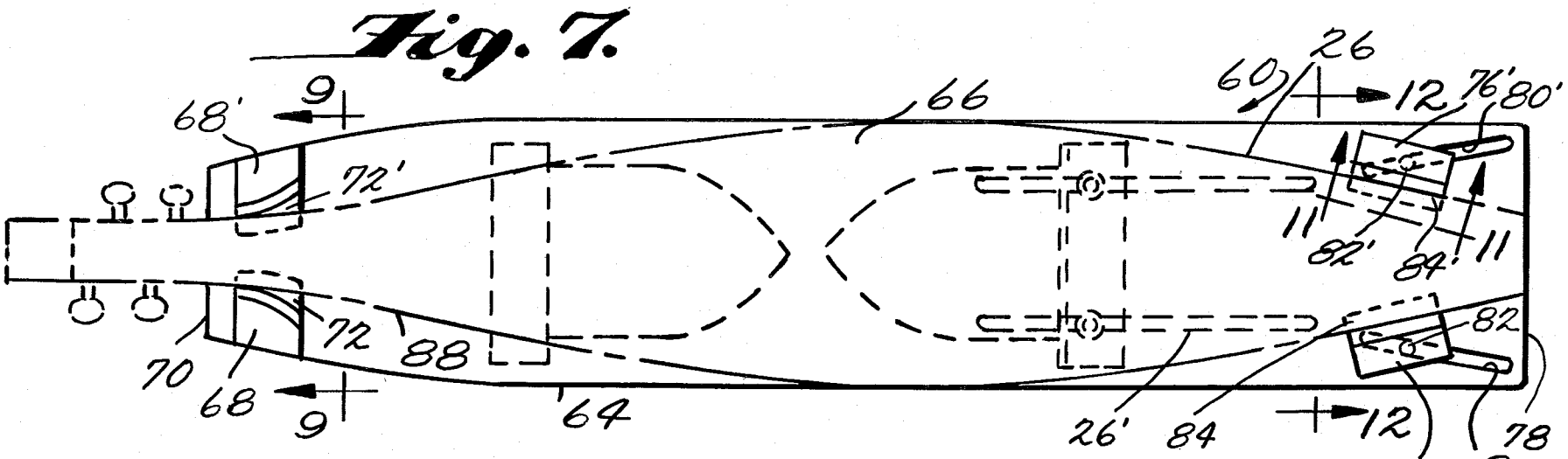
FIG. 7 is a top plan view of another preferred embodiment of the invention and illustrating a dulcimer in dot-dash lines, which dulcimer is removable from the lapboard embodiment.
Figure 8:
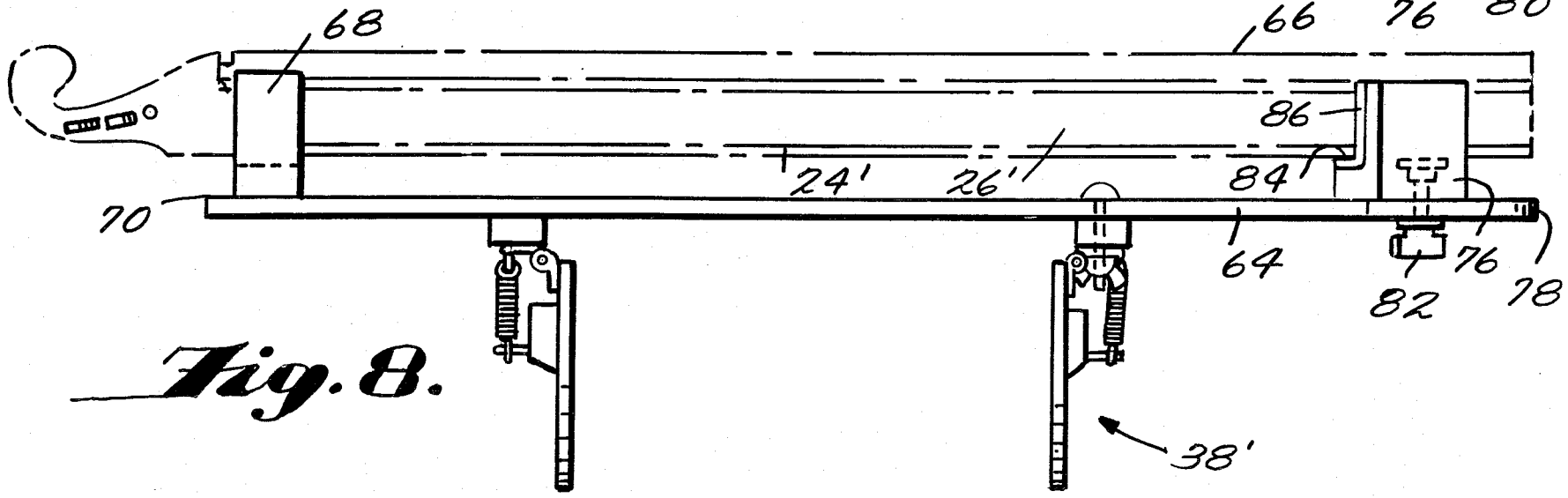
FIG. 8 is a side elevation view of the lapboard illustrated in FIG. 7 and illustrating the dulcimer in dot-dash lines removably mounted on the lapboard.

With reference now to the drawings, wherein like reference characters designate like or corresponding parts throughout the several views, there is shown in FIG. 1 an Appalachian dulcimer 20 having a lapboard 22 integrally built into the dulcimer for the purpose of keeping the dulcimer on the performer's lap while the instrument is being played and for preventing contact of bottom plate 24 of the dulcimer with the performer's lap.

Although the description of the invention is with respect to the Appalachian dulcimer, it should be understood that the invention is equally applicable to other stringed instruments which are played while positioned on the performer's lap.

The instrument illustrated in FIGS. 1-6 defines a sound box formed by bottom plate 24, side pieces 26, end block 28, peg block or scroll piece 30, and sounding board or top plate 32.

A substantially planar-shaped base member 34 is permanently attached to and spaced apart from bottom plate 24 by means of mounting members 36. Bottom plate 24 and base member 34 are preferably substantially the same size and shape, with the exception of the thickness dimensions. Means 38 are provided for grasping the performer's legs so that the instrument is held in a substantially fixed position on the performer's lap and so that the sound quality of the instrument is enhanced by avoiding contact of bottom plate 24 of the sound box with the performer's lap. This allows bottom plate 24 to vibrate freely, and the tone level and quality of the instrument are enhanced.

Leg grasping means 38 preferably include a first flap member 40 attached to support portion 34' of base member 34 by means of spring-loaded hinge 42. A slide member 44 is movably attached to base member 34 by means of bolts 46 extending through elongated openings 48 in base member 34 and wing nuts 50 threaded on to bolts 46. A second flap member 52 is attached to slide member 44 by spring-loaded hinge 42'.

Each of flap members 40, 52 defines an inner surface 54, 54' respectively, for contacting the performer's legs and an outer surface 56, 56' respectively, opposed to the inner surfaces. Spring 58 is attached to outer surface 56 of flap member 40 and to support portion 34' of base member 34. Similarly, spring 58' is attached to outer surface 56' of flap member 52, and the opposite end of spring 58' is attached to slide member 44. Springs, 58, 58' oppose the spring action of hinges 42, 42' so that flap members 40 and 52 do not slam against the bottom surface of base member 34 when the instrument is removed from the performer's lap.

This embodiment of the invention is used by first adjusting the distance between flap members 40 and 52 to accomodate the lap width of the performer. This adjustment is accomplished by first loosening wing nuts 50 and then sliding slide member 44 and bolts 46 along openings 48. Openings 48 are parallel to one another to enable bolts 46 to be moved simultaneously back and forth along the entire length of openings 48.

When the desired distance between flap members 40 and 52 is achieved, slide member 44 is fixed in position by tightening wing nuts 50 on bolts 46. Instrument 20 is then placed on to the performer's lap and flap members 40 and 52 are pivoted about spring-loaded hinges 42,42' so that inside surfaces 54, 54' of the flap members contact the performer's legs. The tension created by hinges 42, 42' causes the flap members to grip the performer's legs and the instrument is maintained in position on the performer's lap. Bottom plate 24 of the instrument is separated from contact with the performer's lap and is also separated from base member 34 by means of mounting members 36. As a result, bottom plate 24 of the instrument sound box can vibrate freely and the tone level and quality of the instrument are enhanced.

Another preferred embodiment of the invention is shown in FIGS. 7-12 wherein means 60 for supporting and gripping a dulcimer or like instrument are illustrated. As in the previously described embodiment, means 38' are attached to supporting means 60 for grasping the performer's legs. Grasping means 38' are constructed in the same manner as grasping means 38 previously described with respect to the earlier embodiment of the invention.

Supporting means 60 include a substantially planar base member 64 and support means for receiving dulcimer 66 and for positioning the dulcimer in spaced apart relationship with respect to base member 64.

The support means include first support members 68, 68' attached to and adjacent a first end 70 of base member 64. Each of support members 68, 68' extends above the substantially planar surface of base member 64, and each of support members 68, 68' defines a first support surface 72, 72' respectively, located above and substantially parallel with respect to the planar surface of base member 64. Each of support members 68, 68' also defines an arcuate surface 74, 74' respectively (FIGS. 9 and 10), which extends upwardly from and substantially at a right angle with respect to support surfaces 72, 72'.

Second support members 76, 76' are movably attached to and adjacent a second end 78 of base member 64, and each of support members 76, 76' extends above the substantially planar surface of base member 64. More specifically, base member 64 defines a second pair 80, 80' of elongated openings located adjacent to second end 78 of the base member, and adjustable fastening means 82, 82' extend through openings 80, 80' and are attached in adjustable relationship to support members 76, 76' respectively, for enabling the support members to be moved to accommodate dulcimers or other instruments of various sizes and shapes.

Each of support members 76, 76' defines a support surface 84, 84' respectively, (FIGS. 11 and 12) located above and substantially parallel with respect to the planar surface of base member 64 for receiving and supporting a portion of the dulcimer or other instrument 66. Each of support members 76, 76' also defines an additional surface 86, 86' respectively, which extends upwardly from and substantially at a right angle with respect to surfaces 84, 84'. Each of surfaces 84, 84' and 86, 86' are preferably lined with cork or other material in order to avoid scratching of instrument 66. Similarly, surfaces 72, 72' and 74, 74' on support members 68, 68' are lined with cork or other soft material.

In use of the lapboard illustrated in FIGS. 7-12, instrument 66 is first placed with bottom plate 24' of the instrument on support surfaces 72, 72' of support members 68, 68'. The instrument is then urged further into the space between support members 68, 68' until the widening throat of the instrument firmly contacts arcuate surfaces 74, 74'.

Support members 76, 76' are then moved with respect to openings 80, 80' and are simultaneously rotated about fastening means 82, 82' until additional surfaces 86, 86' firmly contact side pieces 26' of the instrument and support surfaces 84, and 84' firmly contact and support bottom plate 24' of the instrument. Fastening means 82, 82' are then tightened to fixedly position support members 76, 76' in gripping relationship with the instrument. The instrument is then firmly held in place on the lapboard, and the lapboard is then positioned on the performer's lap by following the same procedure as that described with respect to the preceeding embodiment.

Figure 13:
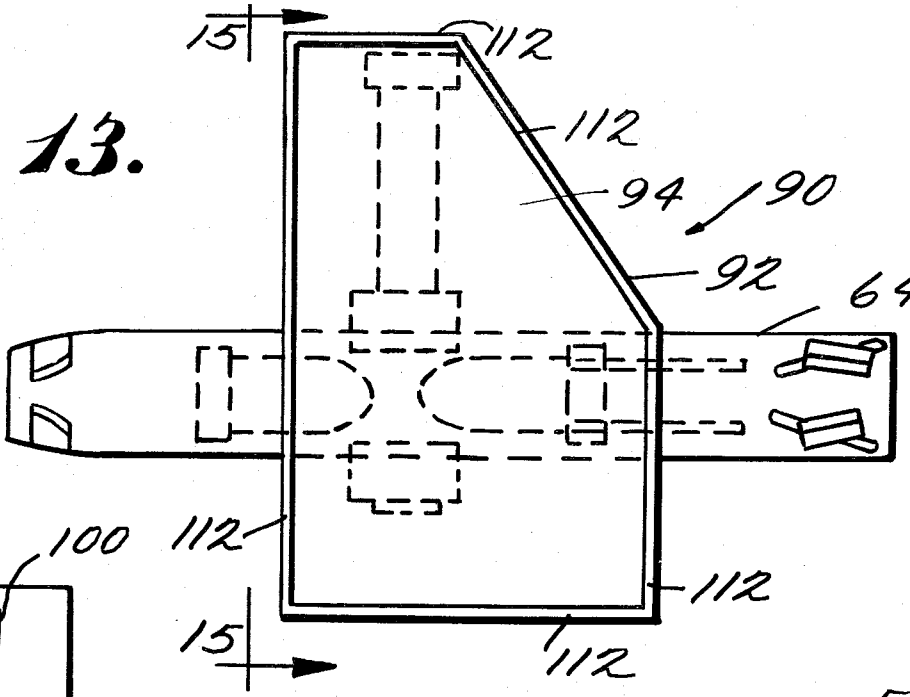
FIG. 13 is a top plan view of another embodiment of the invention providing for a zither adapter to be positioned on the lapboard illustrated in FIG. 7.
Figure 14:
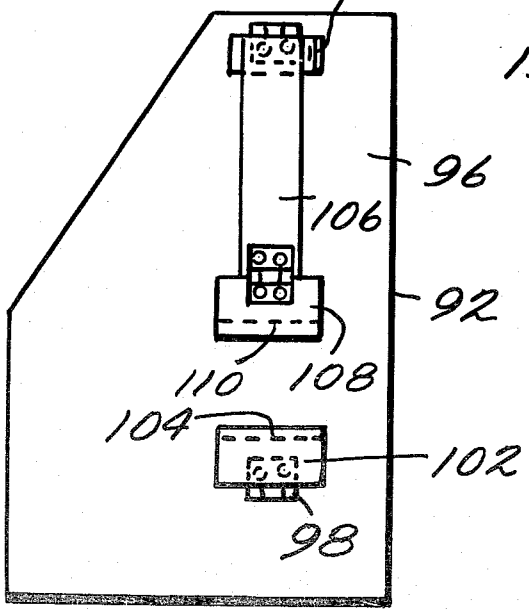
FIG. 14 is a bottom plan view of the zither adapter.
Figure 15:
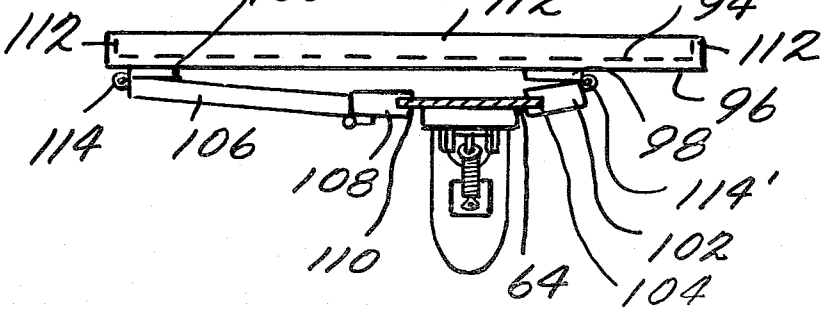
FIG. 15 is a sectional view along line 15—15 of FIG. 13 looking in the direction of the arrows.

Another preferred embodiment of this invention is illustrated in FIGS. 13–15. This embodiment is an adapter for use with the lapboard illustrated in FIGS. 7–12 and wherein the adapter is designed to receive and support a zither.

With reference now to FIG. 13, there is shown a zither adapter 90 attached to base member 64 of the dulcimer lapboard embodiment. Adapter 90 includes a substantially planar, zither supporting member 92 having an upper surface 94 for receiving a zither (not shown) and having an opposed lower surface 96. A first mounting member 98 is attached to lower surface 96 of the adapter and a second mounting member 100 is also attached to lower surface 96. A third member 102 is hingedly attached to member 98 and defines a first slot 104 of predetermined dimensions for receiving an edge of base member 64.

An arm member 106 is hingedly attached to mounting member 100, and a fourth member 108 is hingedly attached to arm member 106 and defines a second slot 110 of predetermined dimensions for receiving an edge of base member 64.

Retaining members 112 are attached to upper surface 94 of the adapter and adjacent to at least a portion of the perimeter of supporting member 92 for holding a zither in place on the supporting member.

The dimensions and locations of members 102, 106 and 108 are such that the closest distance achievable between members 102 and 108 by means of hinged movements thereof and by means of hinged movements of arm member 106 is less than the maximum widthwise dimension of base member 64. This is an important feature of this invention embodiment which enables the weight of supporting member 92 to maintain slots 104 and 110 in continued engagement with the edges of base member 64 after adapter 90 is initially placed on the dulcimer lapboard with the slots engaging the base member edges. Only when supporting member 92 is raised upwardly and away from the dulcimer lapboard will slots 104, 110 be disengaged from the edges of base member 64 so as to release adapter 90 from the dulcimer lapboard. As long as the weight of supporting member 92 is allowed to cause members 102 and 106 to close about hinges 114, 114', members 102 and 108 will remain in gripping relationship with respect to base member 64 by means of slots 104, 110.

In addition to the purposes and embodiments specifically described, the dulcimer lapboard can be used as a mother board for adapter plates for other instruments in addition to zithers. The dulcimer lapboard can also be used as a foundation for a variety of adapter plates for other endeavors besides receiving and holding musical instruments. The dulcimer lapboard is designed to accommodate most dulcimers, and the construction of the lapboard of this invention can be modified to accommodate other stringed instruments which are played on the lap.

The invention in its broader aspects is not limited to the specific details shown and described and departures may be made from such details without departing from the principles of the invention and without sacrificing its chief advantages.

What is claimed is:

1. Apparatus for supporting a dulcimer on a person's lap, said apparatus comprising:

first means for supporting and gripping said dulcimer;

means attached to said first means for grasping the person's legs, whereby said apparatus and said dulcimer are held in substantially fixed position on the person's lap;

said first means including a substantially planar base member and support means in operative relationship with said base member for receiving said dulcimer and for positioning said dulcimer in spaced apart relationship with respect to said base member; and said support means including first support members fixedly attached to and adjacent a first end of said base member and extending above the substantially planar surface of said base member, and second support members movably attached to and adjacent to a second end of said base member and extending above the substantially planar surface of said base member.

2. Apparatus as in claim 1 wherein said leg grasping means include:

a first flap member hingedly attached to said base member at a predetermined, fixed location on said base member;

a slide member movably attached to said base member; and a second flap member hingedly attached to said slide member, whereby the distance between said flap members can be adjusted by movement of said slide member to accommodate different lap sizes.

3. Apparatus as in claim 2 wherein said base member defines a first pair of elongated openings extending in substantially parallel relationship to one another and located between said first and second support members, said apparatus further including first fastening means extending through said openings and attached in adjustable relationship to said slide member for enabling said second flap member and said slide member to be moved relative to said first flap member.

4. Apparatus as in claim 3 wherein said base member defines a second pair of elongated openings located adjacent said second end of said base member, said apparatus further including second fastening means extending through said second pair of openings and attached in adjustable relationship to said second support members for enabling said second support members to be moved to accommodate dulcimers or other like instruments of various sizes and shapes.

5. Apparatus as in claim 4 wherein each of said first support members includes a first support surface located above and substantially parallel with respect to said planar surface of said base member for receiving and supporting a portion of said dulcimer, and an arcuate surface extending upwardly from and substantially at a right angle with respect to said support surface for engaging said dulcimer.

6. Apparatus as in claim 5 wherein each of said second support members includes a second support surface located above and substantially parallel with respect to said planar surface of said base member for receiving and supporting a portion of said dulcimer, and an additional surface extending upwardly from and substantially at a right angle with respect to said second surface for engaging said dulcimer.

7. Apparatus as in claim 6 further including a cork material attached to each of said first and second support surfaces and to each of said arcuate and additional surfaces for protecting the dulcimer against damage.

8. Apparatus as in claim 7 further including spring-loaded hinges attaching said first and second flap members to said base member and to said slide member, respectively.

9. Apparatus as in claim 8 wherein each of said flap members defines an inner surface for contacting the person's legs and an outer surface opposed to said inner surface, said apparatus further including a first spring attached to said outer surface of said first flap member and also attached to said base member, and a second spring attached to said outer surface of said second flap member and also attached to said slide member, said springs acting to prevent said flap members from hitting against said base member when the apparatus is removed from the person's lap.

10. In a stringed musical instrument to be played on a person's lap and having a sound box at least partially defined by a bottom plate, the improvement comprising:

a base member spaced apart from said bottom plate;

mounting members permanently attached to and between said bottom plate and said base member for maintaining said bottom plate and said base member in spaced apart relationship;

means attached to said base member for grasping the person's legs, whereby said instrument is held in substantially fixed position on the person's lap and whereby the sound quality of the instrument is enhanced by avoiding contact of the bottom plate of the sound box with the person's lap; and wherein said bottom plate and said base member are substantially the same size and shape and wherein each is substantially planar.

11. An instrument as in claim 10 wherein said leg grasping means include:

a first flap member hingedly attached to said base member at a predetermined, fixed location on said base member;

a slide member movably attached to said base member; and a second flap member hingedly attached to said slide member, whereby the distance between said flap members can be adjusted by movement of said slide member to accomodate different lap sizes.

12. An instrument as in claim 11 further including spring-loaded hinges attaching said first and second flap members to said base member and to said slide member, respectively.

13. An instrument as in claim 12 wherein each of said flap members defines an inner surface for contacting the person's legs and an outer surface opposed to said inner surface, said instrument further including a first spring attached to said outer surface of said first flap member and also attached to said base member, and a second spring attached to said outer surface of said second flap member and also attached to said slide member, said springs acting to prevent said flap member from hitting against said base member when the instrument is removed from the person's lap.

* * * * *